United States Patent [19]

Modi

[11] 4,305,679

[45] Dec. 15, 1981

[54] MANHOLE SEALING DEVICE

[76] Inventor: Arvind O. Modi, 8706 W. Lancaster Ave., Milwaukee, Wis. 53203

[21] Appl. No.: 225,960

[22] Filed: Jan. 19, 1981

[51] Int. Cl.[3] ..... E02D 29/14

[52] U.S. Cl. ..... 404/25; 210/165; 52/20; 220/256

[58] Field of Search ..... 404/25, 26, 5; 52/19, 52/20; 210/163, 164, 165; 49/466; 220/254, 256

[56] References Cited

U.S. PATENT DOCUMENTS

| | | | |
|---|---|---|---|
| 606,554 | 6/1898 | Jacobs | 404/25 X |
| 1,066,316 | 7/1913 | Piper | 404/5 X |
| 2,095,024 | 10/1937 | Boosey | 210/165 X |
| 2,163,221 | 6/1939 | Slocum | 404/25 |
| 3,103,083 | 9/1963 | Seeger | 49/466 X |
| 3,712,009 | 1/1973 | Campagna | 404/25 X |
| 3,973,856 | 8/1976 | Gaglioti | 404/25 |
| 4,067,659 | 1/1978 | Campagna | 404/25 |
| 4,101,236 | 7/1978 | Meyer | 404/25 |

FOREIGN PATENT DOCUMENTS

| | | | |
|---|---|---|---|
| 957878 | 6/1949 | France | 404/25 |

OTHER PUBLICATIONS

Distributed by-Methods Engineering Corp., Title: Let It Rain . . . It's Dry Under Here.

*Primary Examiner*—Nile C. Byers, Jr.

*Attorney, Agent, or Firm*—Wheeler, House, Fuller & Hohenfeldt

[57] ABSTRACT

Manhole sealing device to prevent water from entering a manhole through the corbel joint between the manhole casing and cover frame. The device comprises a flexible tube like membrane spanning the corbel joint of the manhole and provided with first sealing means above the corbel joint to seal the membrane against the inside wall of the cover frame and second sealing means below the corbel joint to seal the flexible membrane against the inside wall of the manhole casing. The portion of the membrane between the first and second sealing means is preferably provided with enough slack to form a inward fold defining an annular pocket to contain any water or other fluids entering the manhole through the corbel joint thereof. In a preferred mode of the present invention the membrane is a bag with a closed bottom to catch any water entering the manhole through or around the manhole cover. The manhole sealing device can be installed in an existing manhole without replacing any of the structural parts thereof.

15 Claims, 4 Drawing Figures

MANHOLE SEALING DEVICE

TECHNICAL FIELD

The present invention relates to manholes for providing limited access to an underground room or tunnel which contains a utility conduit or sewer pipe. A typical manhole comprises an underground masonry casing, a cover frame resting on the top of the casing at a corbel joint and protruding through the pavement of a street or the like, and a manhole cover received in the cover frame and removable or hinged to allow access to the manhole.

BACKGROUND ART

It has been common in the past to use a single network of sewers to convey sewage and storm runoff to a central point for disposal. The combination of storm and sanitary sewers floods the sewage treatment plant every time it rains, and the sewage is not adequately treated, storm water is not carried off at an adequate rate, or both problems occur. Thus, the art has recently felt a need for means to prevent storm runoff from entering sanitary sewer systems.

One entry point for storm water into a sanitary sewer is through the manholes which provide access to the sanitary sewer; it is important to seal these manholes. The art has realized this need to the extent of providing a seal between the cover and cover frame of a manhole, and by providing manhole covers which are impervious to storm water. But water can also enter the manhole through the corbel joint between the casing and cover frame of the manhole, either by seeping along the outside of the cover frame from the surface or by flowing as subsurface water under the pavement and through the corbel joint.

This joint is difficult to seal. First, iron and masonry parts interface at the corbel joint, and each has a different thermal coefficient of expansion, causing relative movement between the cover frame and casing at the corbel joint as the ambient temperature changes. Second, the casing moves relative to the cover frame each time a heavy vehicle passes near or over the manhole. Finally, the manhole cover frame frequently needs to be lifted when a road is repaved or when the manhole cover frame has settled into an existing pavement. When the manhole is raised, the cover frame and manhole casing can become separated, or an additional joint is formed between them. The prior art has not addressed the problem of sealing a manhole corbel joint.

Another problem with some manhole sealing means known to the prior art is the need to replace existing manhole covers, the cover frames, or other parts of a manhole to seal the manhole against entry of water. Since many areas already have a great number of manholes, the need to replace parts of a manhole assembly before they wear out or are broken can exact a great financial burden on the government responsible for sealing the manhole.

Finally, some prior art manhole sealing means raise the manhole cover above pavement level, causing damage to the manhole when vehicles strike the raised manhole cover, and making the real surface uneven.

SUMMARY OF THE INVENTION

The present invention is a manhole sealing device which can be installed in a manhole to prevent water from entering the manhole. The sealing device comprises a flexible membrane formed as a tube for spanning the inside of a manhole corbel joint, means for forming a first seal between the membrane and a manhole cover frame above the corbel joint, and means for forming a second seal between the membrane and a manhole casing below the corbel joint. The present invention interacts with but does not include the casing, cover frame, or cover of a manhole, as these can be conventional elements already in use.

In a preferred embodiment of the invention slack in the membrane between the first and second sealing means allows relative movement between the cover frame and the manhole casing without disturbing the seal of the membrane to either member. Thus, relative motion of the parts of the manhole due to weather and vibrations does not disturb the seals which isolate the corbel joint from the inside of the manhole.

In another preferred embodiment of the present invention, the membrane has a closed bottom which prevents water from entering the manhole through the joint between the cover frame and the cover or through apertures in the cover. Thus, the present invention can also be adapted to seal manholes wherein the cover has pick holes or vent holes, so the manhole can be sealed without replacing the manhole cover.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
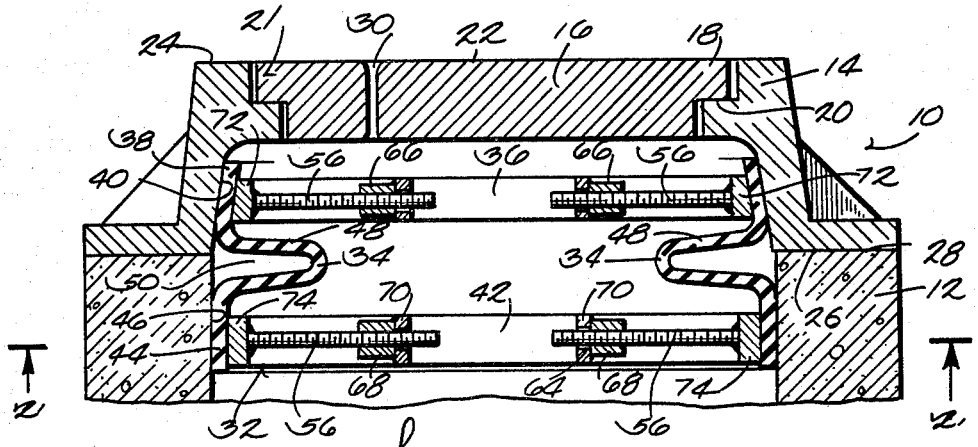
FIG. 1 is a fragmentary vertical cross section of one embodiment of the present invention installed in a conventional manhole.

Referring first to FIG. 1, a conventional manhole 10 comprises a masonry casing 12 and a cover frame 14 usually made of cast iron and supporting a manhole cover 16. Cover 16 has a radially extending flange or edge 18 which rests on a shoulder 20 to form cover joint 21 so that manhole cover 16 is supported with its upper surface 22 at the level of upper edge 24 of the cover frame and of the surrounding street pavement (not shown). The lower edge 26 of the cover frame rests on the upper edge 28 of casing 12 at an interface known as a corbel joint. Finally, in some manholes the manhole cover is perforated by pick holes or vents, shown here as 30.

FIG. 1 shows a manhole sealing device 32 installed in the manhole. Manhole sealing device 32 generally comprises a tube-like waterproof flexible membrane 34, first sealing means 36 for sealing a generally cylindrical top portion 38 of membrane 34 against the inside wall 40 of cover frame 14, and second sealing means 42 for sealing a generally cylindrical bottom portion 44 of membrane 34 to the inside wall 46 of casing 12. Between top portion 38 and bottom portion 44 of flexible membrane 34, the vertical extent of the membrane is preferably greater than the corresponding vertical distance between the first and second sealing means 36, 42. This extra vertical extent is gathered into a fold 48 to form an annular pocket 50 adjacent the corbel joint which isolates the joint from the interior space in the manhole. Fold 48 allows vertical and horizontal motion of cover frame 14 relative to casing 12 without straining either seal and limits the amount of water which can seep in through the corbel joint. The small amount of water which can accumulate in pocket 50, if frozen, will not tend to split the manhole casing or misalign the casing and cover frame to open up the corbel joint.

Figure 2:
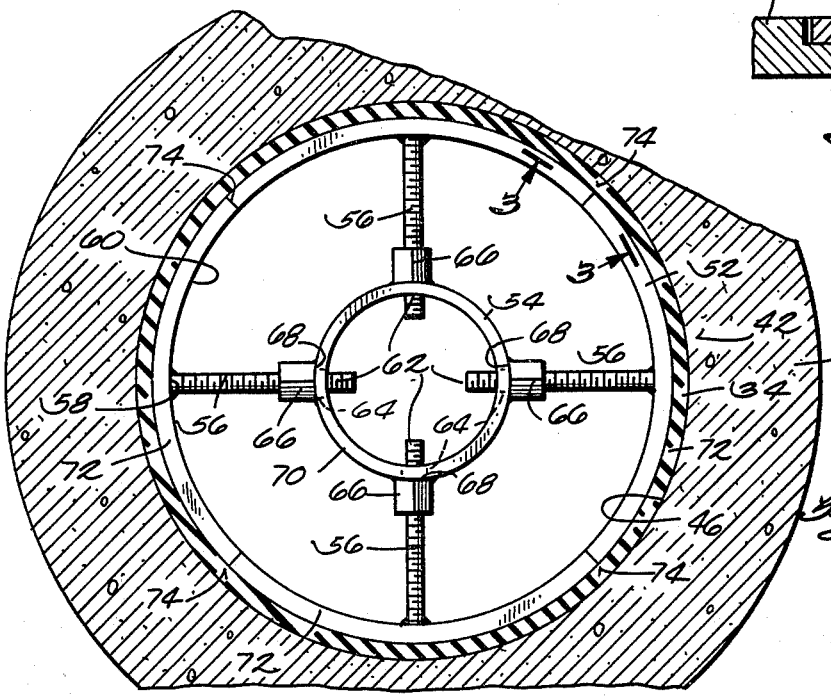
FIG. 2 is a horizontal section taken through line 2—2 in FIG. 1.

FIG. 2 shows a section above second sealing means 42 (which is identical to first sealing means 36). Second sealing means 42 is a brace comprising a concentric membrane engaging rim 52 and hub 54 connected by plural spokes such as 56. Each spoke 56 has a first end 58 for bearing radially outward against the inner face 60 of rim 52; first end 58 can be attached to inner face 60 of the rim. Each spoke 56 also has a second end 62 which passes through and does not directly engage a registered hole 64 in hub 54. Each spoke 56 between its ends is threaded to receive a nut 66 having an inner face 68 for bearing against the outer face 70 of hub 54. When all the nuts 66 are threadably advanced against outer face 70, rim 52 is urged outward toward the inside wall 46 of casing 12.

Although rim 52 may be made of an expandable material, in the preferred embodiment of the invention rim 52 is formed as a series of segments such as 72 so that each spoke bears on an independent segment of the rim 52, allowing slight circumferential expansion at the joint 74 between segments so that the sealing means will be functional despite slight dimensional irregularities in the diameter and shape of the inside wall of casing 12.

Figure 3:
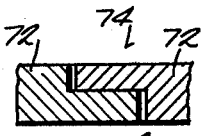
FIG. 3 is an enlarged fragmentary vertical cross section taken along line 3—3 in FIG. 2.

FIG. 3 shows an enlarged view on line 3—3 of a joint 74 between adjacent segments 72 of the rim. The joint 74 is vertically stepped so that even if the segments are separated horizontally, as when the manhole casing has a larger inside wall diameter than is typical, no vertical leakage path is formed to allow water or other fluids to pass between the flexible membrane and the inside wall 46 of casing 12.

Figure 4:
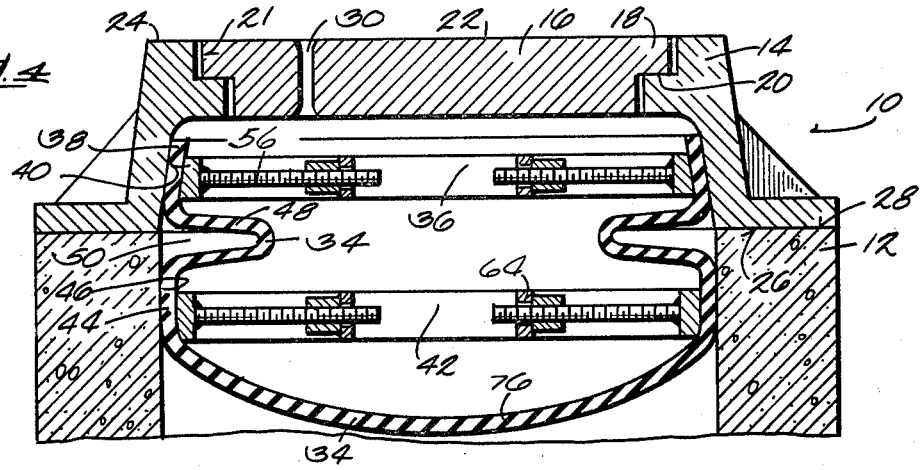
FIG. 4 is a fragmentary vertical cross section of an alternate embodiment of the present invention installed in a conventional manhole.

FIG. 4 shows an alternate embodiment of the invention in which the bottom 76 of membrane 34 is closed below second sealing means 42 to form a bag to catch water passing through pick holes 30 or cover joint 21 and into the manhole. This closed bottom 76 is desirable even when the cover joint is sealed and no apertures are provided in the manhole cover, for the structure shown in FIG. 4 will compensate for leakage due to a faulty cover joint 21. The bag could be inverted.

Either embodiment of the present invention can easily be installed in an existing manhole at modest cost, since the preexisting functional parts of the manhole do not need to be replaced. Also, the manhole sealing device can be easily removed to enter the manhole, yet the device prevents unwanted access to the manhole since the manhole cannot be entered without dissassembling the sealing device. Nut 66 can have an unusual configuration which ordinary household wrenches do not fit to further limit access to the manhole.

I claim:

1. A manhole sealing device comprising a flexible membrane for spanning a manhole corbel joint, means for forming a first seal between said membrane and a manhole cover frame above said corbel joint, and means for forming a second seal between said membrane and a manhole casing below said corbel joint.

2. The device of claim 1, wherein said means for forming a second seal comprises a brace for pressing said membrane radially outward against the inside surface of said manhole casing to form a substantially continuous seal.

3. The device of claim 1, wherein said means for forming a first seal comprises a brace for pressing said membrane radially outward against the inside surface of said manhole cover frame to form a substantially continuous seal.

4. The device of claims 2 or 3, wherein said brace comprises a hub, a membrane engaging rim concentric with and radially outside said hub, and means for expanding said rim radially outward from said hub.

5. The device of claim 4, wherein said rim is segmented.

6. The device of claim 4, wherein said means for extending said rim comprises plural spokes each having a first end bearing radially outward against the inside face of said rim, a second end passing freely through a registered hole in said hub, and a threaded portion between said ends; and a nut threaded on said threaded portion of each spoke and having an inner face for bearing against the outer face of said hub.

7. The device of claim 1, wherein said membrane comprises a tube having a top portion for forming said first seal and a bottom portion for forming said second seal.

8. The device of claim 7, wherein said tube includes a slack portion forming an annular pocket adjacent said corbel joint when said membrane is installed.

9. The device of claim 7, wherein said membrane is closed below said bottom portion.

10. The device of claim 9, wherein said membrane is a bag of flexible material.

11. A manhole sealing device, comprising:

A. a flexible membrane for spanning the corbel joint between the cover frame and casing of said manhole, said membrane comprising a tube of flexible waterproof sheet material having generally cylindrical top and bottom portions;

B. means for forming a substantially continuous first seal between said membrane and an inside wall of said manhole cover frame, comprising a radially expandable brace for urging said membrane top portion against said cover frame inside wall;

C. means for forming a substantially continuous second seal between said membrane and an inside wall of said manhole casing, comprising a radially expandable brace for urging said membrane bottom portion against said casing inside wall;

wherein said membrane has a greater axial length than the distance between the portions of said casing and cover frame inside walls for forming said first and second seals when said device is installed, whereby to cause formation of a radially inward fold in the portion of said membrane between said first and second seals when said device is installed.

12. The device of claim 11, wherein each said brace comprises a hub, a membrane-engaging rim concentric with and radially outside said hub, and means for expanding said rim radially outward from said hub.

13. The device of claim 12, wherein said means for expanding said rim comprises plural spokes each having a first end bearing against the inside of said rim, a second end freely passing through a registered hole in said hub, and a threaded portion between said ends; and a nut threaded on each said threaded portion and having a radially inward face for bearing against the outside of said hub.

14. The device of claim 12, wherein each said rim is segmented, and at least one spoke bears on each segment.

15. The device of claim 11, wherein said membrane is closed below said bottom portion to form a bag for cooperating with said means for forming a second seal to prevent water from entering said manhole casing through the cover or cover seal of said manhole.

* * * * *